US008365912B2

(12) United States Patent
Carroscia et al.

(10) Patent No.: US 8,365,912 B2
(45) Date of Patent: Feb. 5, 2013

(54) WIRE CONTAINMENT STRUCTURE INCLUDING CONTAINER AND BAG

(75) Inventors: Michael A. Carroscia, Newbury, OH (US); Vaidyanath B. Rajan, Mentor, OH (US)

(73) Assignee: Lincoln Global, Inc., Cleveland, OH (US)

( * ) Notice: Subject to any disclaimer, the term of this patent is extended or adjusted under 35 U.S.C. 154(b) by 56 days.

(21) Appl. No.: 12/909,230

(22) Filed: Oct. 21, 2010

(65) Prior Publication Data

US 2012/0097672 A1 Apr. 26, 2012

(51) Int. Cl.
*B65D 85/04* (2006.01)
*B65D 21/02* (2006.01)

(52) U.S. Cl. ..... 206/389; 220/495.06; 220/23.83

(58) Field of Classification Search ..... 206/389, 206/408, 409, 395, 417, 386, 595–600; 383/18, 383/17, 16, 12; 242/170; 229/117.25, 117.24; 294/68.1, 159; 220/495.01, 495.06, 23.86, 220/23.83

See application file for complete search history.

(56) References Cited

U.S. PATENT DOCUMENTS

| | | | | |
|---|---|---|---|---|
| 3,622,056 | A | 11/1971 | Droeger | |
| 3,933,287 | A * | 1/1976 | Foley | 294/149 |
| 4,143,796 | A * | 3/1979 | Williamson et al. | 222/181.3 |
| 4,207,937 | A | 6/1980 | Sandeman et al. | |
| 4,300,608 | A | 11/1981 | Cuthbertson | |
| 4,493,109 | A | 1/1985 | Nattrass | |
| 4,499,599 | A | 2/1985 | Polett et al. | |
| 4,524,457 | A | 6/1985 | Marino | |
| 4,542,826 | A | 9/1985 | Adams | |
| 4,610,028 | A | 9/1986 | Nattrass | |
| 4,664,957 | A | 5/1987 | van de Pol | |
| 4,679,242 | A * | 7/1987 | Brockhaus | 383/4 |
| 4,703,517 | A | 10/1987 | Marino | |
| 4,730,942 | A | 3/1988 | Fulcher | |
| 4,807,299 | A | 2/1989 | Nattrass et al. | |
| 4,832,506 | A | 5/1989 | Juel et al. | |
| 4,948,265 | A | 8/1990 | Futerman | |
| 5,076,710 | A | 12/1991 | Derby | |
| 5,340,218 | A * | 8/1994 | Cuthbertson | 383/67 |

(Continued)

FOREIGN PATENT DOCUMENTS

| | | |
|---|---|---|
| CA | 2005868 | 12/1989 |
| EP | 1149777 A1 | 10/2001 |

(Continued)

OTHER PUBLICATIONS http://www.lbbag.com/products/fibc-bulk-super-sack; retrieved on Dec. 1, 2009, 2 pages.

(Continued)

*Primary Examiner* — Steven A. Reynolds
(74) *Attorney, Agent, or Firm* — Ulmer & Berne LLP

(57) ABSTRACT

A wire containment structure includes a container and a bag. The container includes a sidewall that at least partially defines a container receptacle. The sidewall defines a first handle aperture and a second handle aperture. The bag is configured to entirely support a wire stack. The bag is disposed at least partially within the container receptacle and comprises a body, a first handle, and a second handle. The body defines a wire receptacle. The first handle is coupled with the body and is routed through the first handle aperture. The second handle is coupled with the body and is routed through the second handle aperture.

10 Claims, 3 Drawing Sheets

U.S. PATENT DOCUMENTS

| | | | | |
|---|---|---|---|---|
| 5,492,270 | A * | 2/1996 | Avery et al. | 229/117.24 |
| 5,494,160 | A | 2/1996 | Gelmetti | |
| 5,524,949 | A | 6/1996 | Mooney | |
| 6,857,521 | B2 * | 2/2005 | Cantu-Gonzalez | 206/397 |
| 6,918,699 | B2 | 7/2005 | Hanson | |
| 7,055,876 | B2 | 6/2006 | Woldekidan | |
| 7,222,734 | B2 * | 5/2007 | Barton | 206/389 |
| 7,341,377 | B1 | 3/2008 | Baxter | |
| 7,437,784 | B1 * | 10/2008 | Turnipseed | 5/510 |
| 7,524,111 | B1 | 4/2009 | Williams | |
| 2001/0000464 | A1 * | 4/2001 | Beale | 414/607 |
| 2003/0019776 | A1 | 1/2003 | Matsuguchi et al. | |
| 2004/0007487 | A1 * | 1/2004 | Cantu-Gonzalez | 206/397 |
| 2004/0159565 | A1 * | 8/2004 | Von Merveldt | 206/386 |
| 2005/0145407 | A1 | 7/2005 | Cipriani | |
| 2006/0245671 | A1 | 11/2006 | Sun | |
| 2007/0127852 | A1 * | 6/2007 | Town et al. | 383/16 |
| 2007/0280568 | A1 | 12/2007 | Levy | |
| 2008/0013867 | A1 | 1/2008 | Liu | |
| 2009/0080808 | A1 | 3/2009 | Hagen | |
| 2009/0250460 | A1 * | 10/2009 | Chang | 220/9.4 |

FOREIGN PATENT DOCUMENTS

| | | |
|---|---|---|
| EP | 1275595 A2 | 1/2003 |
| EP | 1932613 A1 | 6/2008 |
| GB | 2103576 | 2/1983 |
| GB | 2194215 | 3/1988 |
| WO | 9634812 A1 | 11/1996 |

OTHER PUBLICATIONS

PCT International Search Report for International Application No. PCT/IB2011/002332, international filing date: Oct. 5, 2011; mailed on Feb. 16, 2012; in its entirety.

PCT Written Opinion of the International Searching Authority for International Application No. PCT/IB2011/002332, international filed: Oct. 5, 2011; mailed on Feb. 16, 2012; in its entirety.

Written Opinion of the International Preliminary Examining Authority, issued in related International Application No. PCT/IB2011/002332, dated Oct. 17, 2012, 5 pages in its entirety.

* cited by examiner

WIRE CONTAINMENT STRUCTURE INCLUDING CONTAINER AND BAG

TECHNICAL FIELD

A wire containment structure includes a container and a bag. The bag is disposed within the container and includes a handle to facilitate, lifting of the wire containment structure.

BACKGROUND

A wire stack can be provided within a wire containment structure. The wire containment structure includes handles that facilitate lifting and/or transporting of the wire stack with the wire containment structure. In one conventional arrangement, a wire containment structure includes, a rigid outer container, such as a cardboard box. A polyethylene bag is provided within the rigid outer container and the wire stack is provided within the bag. The bag is closed over the wire stack to inhibit moisture from affecting the wire stack. A lifting strap is routed underneath the bag such that it is interposed between the rigid outer container and the bag. In this configuration, the lifting strap is not integrally formed together with the bag, but rather is provided as a separate component. The lifting strap includes two handles that are routed through opposite sidewalls of the rigid outer container to facilitate lifting of the wire containment structure and the wire stack with the handles. However, since the lifting strap is separate from the bag, the bag is prone to deterioration due to chafing from the strap. In addition, use of a lifting strap separate from the bag might require the wire containment structure to comply with certain safety and/or transportation standards which can be time consuming and costly to implement.

SUMMARY

In accordance with one embodiment, a wire containment structure comprises a container and a bag. The container comprises a sidewall that at least partially defines a container receptacle. The sidewall defines a first handle aperture and a second handle aperture. The bag is configured to entirely support a wire stack. The bag is disposed at least partially within the container receptacle and comprises a body, a first handle, and a second handle. The body defines a wire receptacle. The first handle is coupled with the body and is routed through the first handle aperture. The second handle is coupled with the body and is routed through the second handle aperture.

BRIEF DESCRIPTION OF THE DRAWINGS

While the specification concludes with claims particularly pointing out and distinctly claiming the invention, it is believed that the same will be better understood from the following description taken in conjunction with the accompanying drawings in which:

DETAILED DESCRIPTION

Figure 1:
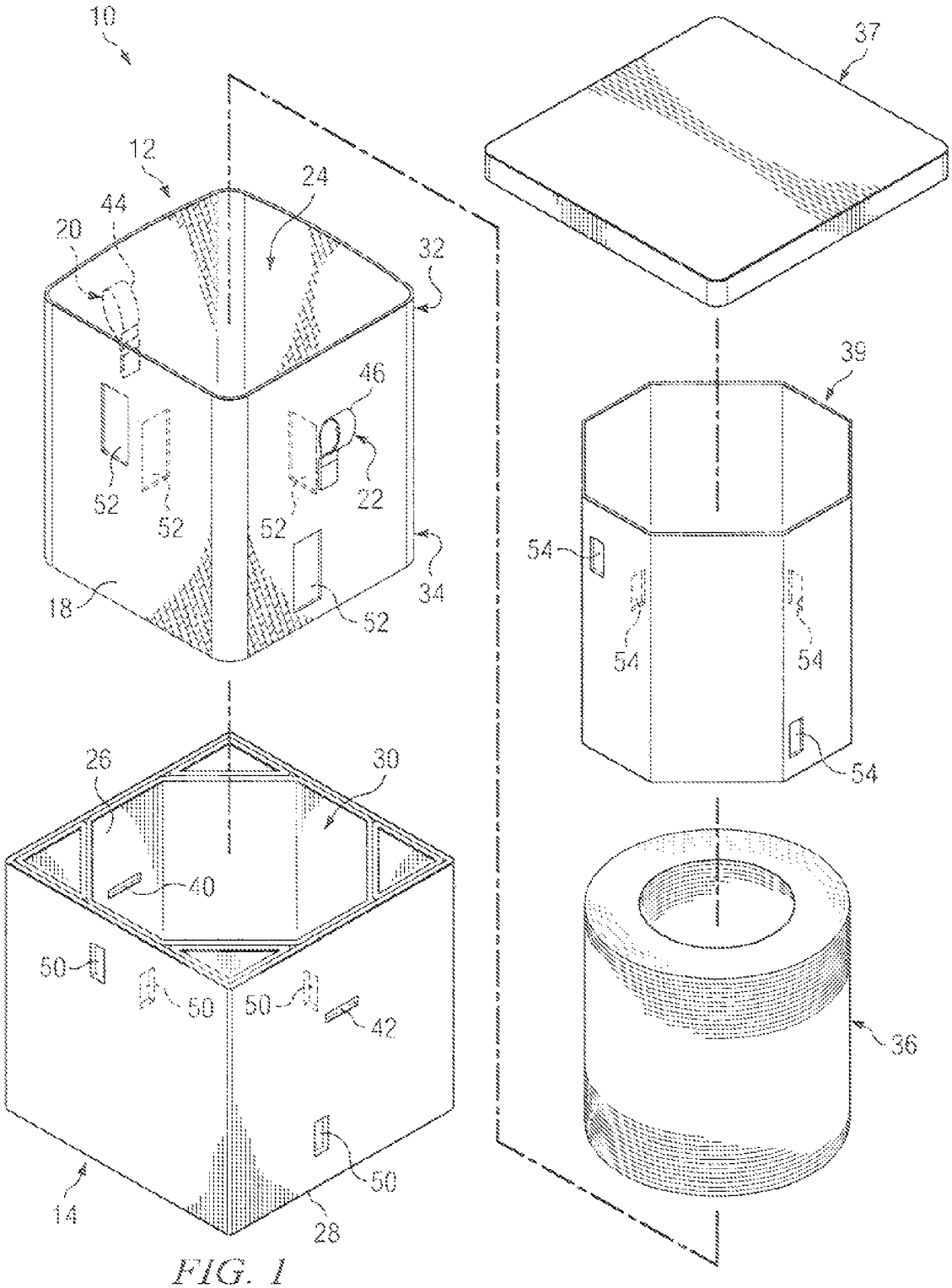
FIG. 1 is an exploded perspective view depicting it wire stack in association with a wire containment structure that includes a container, a bag, an inner support member, and a lid, according to one embodiment.
Figure 2:
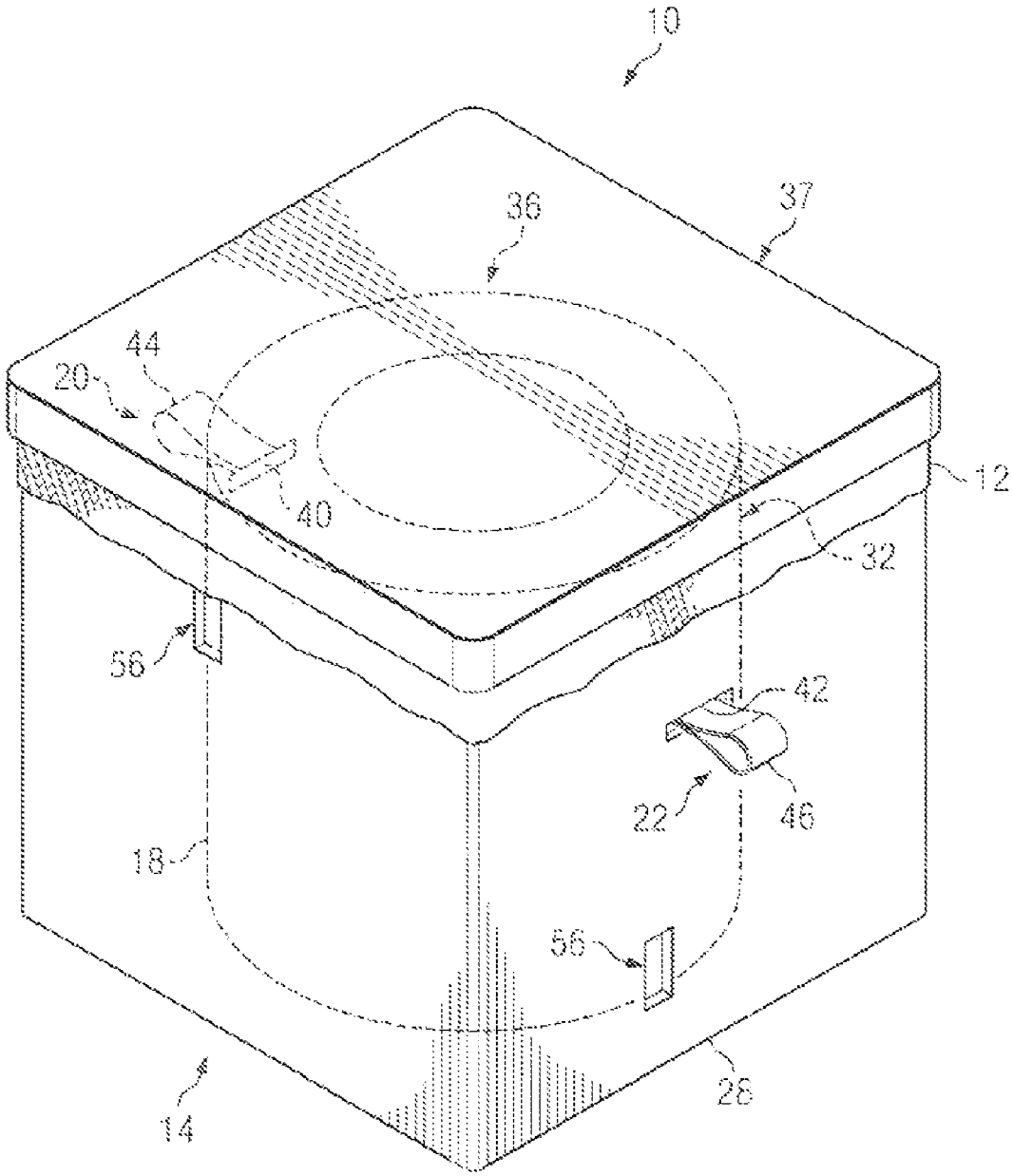
FIG. 2 is an assembled view of the wire containment structure of FIG. 1 wherein the wire stack is disposed within the bag.

Embodiments are hereinafter described in detail in connection with the views of FIGS. 1-4, wherein like numbers indicate the same or corresponding elements throughout the views. As illustrated in FIG. 1, a wire containment structure 10 can include a bag 12 and container 14. The bag 12 can include a body 18, and first and second handles 20, 22 that are coupled with the body 18. The body 18 of the bag 12 can define a wire receptacle 24. The container 14 can include a sidewall 26 and a floor portion 28 that can cooperate to define a container receptacle 30. As illustrated in FIG. 2, the bag 12 can be disposed within the container receptacle 30 such that the body 18 of the bag 12 lines the container 14. The body 18 of the bag 12 can include an upper portion 32 and a lower portion 34. As illustrated in FIG. 2, the upper portion 32 of the body 18 can extend beyond the container 14 and can be folded over the top of the container 14.

As illustrated in FIG. 2, a wire stack 36 can be provided within the wire containment structure 10 (e.g., into the wire receptacle 24 of the bag 12) such that the wire stack 36 rests upon the floor portion 28 of the container 14 with the body 18 of the bag 12 interposed between the floor portion 28 and the wire stack 36. The wire stack 36 is shown to be a wound stack of wire, but can be any of a variety of other wire stacks, such as a wire spool or a wire bundle, for example. By folding the upper portion 32 of the bag 12 over the top of the container 14, the bag 12 can be upheld by the container 14 during loading of the wire stack 36 into the wire containment structure 10. A lid 37 can be provided over the bag 12 and the container 14. The container 14 and the lid 37 can be formed from a substantially rigid material such as cardboard or plastic. The container 14 and the lid 37 are shown to be square-shaped, but can be provided in any of a variety of suitable alternative arrangements. When the wire stack 36 is provided within the wire containment structure 10, the container 14 can accordingly protect the wire stack 36 from debris and other material that might otherwise contact and damage the wire stack 36 (e.g., during transportation of the wire containment structure 10). In one embodiment, the container 14 can be rigid enough to facilitate stacking of multiple wire containment structures upon one another.

In one embodiment, as illustrated in FIG. 2, the upper portion 32 of the bag 12 can be interposed between the container 14 and the lid 37 such that the bag 12, the container 14, and the lid 37 cooperate to prevent moisture from entering the wire receptacle 24 and affecting the wire stack 36. However, in another embodiment, the upper portion 32 of the bag 12 can be accumulated together and sealed (e.g. with a metal clip) prior to covering the container 14 with the lid 37 to more effectively prevent moisture from affecting the wire stack 36.

In one embodiment, as illustrated in FIG. 1, the wire containment structure 10 can include an inner support member 39. When the wire stack 36 is provided within the wire containment structure 10, the inner support member 39 can be provided around the wire stack 36 such that the inner support member 39 is interposed between the wire stack 36 and the bag 12. The inner support member 39 can surround the wire stack 36 and can accordingly prevent the wire stack 36 from unraveling. The inner support member 39 can also provide support along the perimeter of the wire stack 36 to prevent the wire stack 36 from shifting and/or falling over during transportation of the wire containment structure 10. In one embodiment, the inner support member 39 can extend between the floor portion 28 of the container 14 and the lid 37 to provide additional underlying support for the lid 37 (e.g., to facilitate more effective support when wire containment structures are stacked on top of each other). The inner support member 39 can comprise a rigid tubular member formed from cardboard, thermoplastic, or any of a variety of suitable alternative materials. It will be appreciated that although the inner support member is shown to be octagonal-shaped, an inner support member can comprise any of a variety of suitable alternative shapes, such as rectangular or circular, for example.

As illustrated in FIG. 1, the sidewall 26 of the container 14 can define a plurality of wall windows 50, the bag 12 can define a plurality of bag windows 52, and the inner support member 39 can define a plurality of support windows 54. When the bag 12 and the inner support member 39 are disposed within the container 14, each of the wall windows 50 can be substantially aligned with a respective one of the bag windows 52 and the support windows 54 and can cooperate to form a plurality of viewing windows 56 (FIG. 2) through the wire containment structure 10. The wire stack 36 can accordingly be viewed through the viewing windows 56. In one embodiment, the wall windows 50 and the support windows 54 can comprise apertures. The bag windows 52 can be defined by a substantially transparent lamination that is integrally formed with the rest of the body 18 of the bag 12 such that the integrity of the bag 12 is not substantially affected by the bag windows 52. It will be appreciated that the viewing windows 56 can be disposed at different heights such that the height of the wire stack 36 can be determined without removing the lid 37 to look inside of the container 14. It will also be appreciated that although four viewing windows 56 are shown in FIGS. 1 and 2, a bag, an inner support member, and a container can cooperate to form any number of viewing windows for a wire stack at any of a variety of suitable alternative locations.

The sidewall 26 of the container 14 can define a first handle aperture 40 and a second handle aperture 42. As illustrated in FIG. 2, the first and second handles 20, 22 of the bag 12 can be routed through the respective first and second handle apertures 40, 42 to facilitate top lifting of the wire containment structure 10. In one embodiment, the first and second handles 20, 22 of the bag 12 can include respective first and second looped ends 44, 46 that can facilitate lifting and transportation of the wire containment structure 10 by a forklift (not shown), a crane (not shown), or other suitable alternative lifting apparatus. For example, forks from a forklift can be provided into the first and second looped ends 44, 46 and the wire containment structure 10 can be lifted by lifting the forks. It will be appreciated that, prior to lifting the wire containment structure 10, the first and second looped ends 44, 46 can be provided along the outside of the container 14 such that they are ready to receive the forklift's forks. When multiple wire containment structures are provided (e.g., at a storage facility), the width of the forks can be set to match the location of the first and second looped ends 44, 46. An operator can lift and move each of the wire containment structures (e.g., 10) without disembarking from the forklift to readjust the forks, thereby saving time and reducing the risk to the operator. It will be appreciated that the first and second handles 20, 22 can include any of a variety of suitable, alternative handle arrangements that at least partially extend into the respective first and second handle apertures.

Lifting the wire containment structure 10 with the first and second handles 20, 22 enables the weight of the wire stack 36 to heat least partially borne by the bag 12. For example, when the wire containment structure 10 is lifted with the first and second handles 20, 22, the first and second handles 20, 22 can pull the body 18 of the bag 12 upwardly and against the wire stack 36 such that the bag 12 provides substantial underlying support for the wire stack 36. The bag 12 can accordingly be configured to support the wire stack 36 during lifting of the wire stack 36 with the first and second handles 20, 22 (e.g., without tearing, ripping or breaking). In one embodiment, the bag 12 can be formed from a material that can support the entire weight of the wire stack 36, such as, for example, a woven polypropylene sheet having a thickness that complies with accepted industry standards necessary for the load. In one embodiment, the thickness can range from about 0.01 inch to about 0.03 inch, and more specifically can range between from about 0.015 inch to about 0.020 inch.

In one embodiment, the body 18, the first handle 20, and the second handle 22, can be provided in a one-piece construction. For example, the bag 12 can be formed from a continuous sheet of material that is cut or otherwise formed into a pattern that has opposing edges. The edges of the continuous sheet of material can be sewn, heat welded, or otherwise attached together to form the body 18 of the bag 12. The first handle 20 and the second handle 22 can be coupled with the body 18 of the bag 12 such that the first and second handles 20, 22 are not separable from the body 18 except through cutting, heating, or the like. In one embodiment, the first and second handles 20, 22 can be attached to the body 18 through sewing or heat welding. In another embodiment, the first and second handles 20, 22 can be integrally woven with the material that forms the body 18 of the bag 12 such as by interweaving the first and second handles 20, 22 with the body 18 of the bag 12 during manufacturing, for example. It will be appreciated, however, that the bag 12 can be formed having any of a variety of other suitable arrangements and using any of a variety of suitable alternative materials that facilitate a body, a first handle, and a second handle being coupled together or provided as a one-piece construction.

Figure 4:
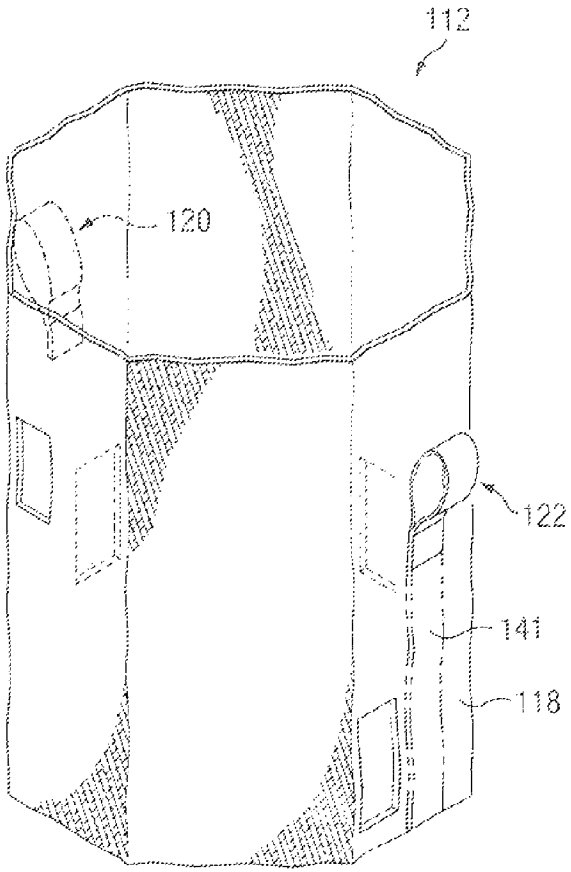
FIG. 4 is a perspective view of a bag of the wire containment structure of FIG. 1, according to another embodiment.
Figure 3:
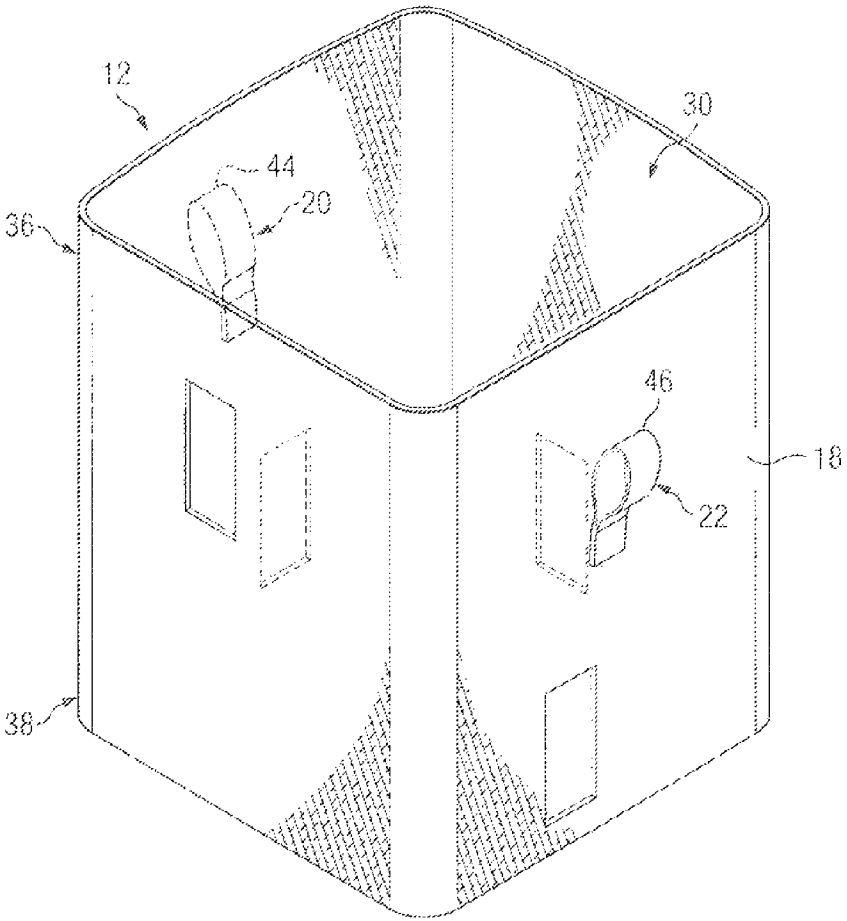
FIG. 3 is a perspective view of the bag of the wire containment structure of FIG. 1, according to one embodiment.

In an alternative embodiment, as illustrated in FIG. 4, a bag 112 can also include a reinforcement strap 141. The bag 112 can be similar in many respects to bag 12 illustrated in FIGS. 1-3. For example, the bag 112 can include a body 118, a second handle 120, and a first handle 122. The reinforcement strap 141 can extend beneath the body 118 of the bag 112 to provide additional lifting support for the bag 112. The body 118, the first handle 120, the second handle 122, and the reinforcement strap 141 can be integrally formed together as a one-piece construction. For example, the bag 112 can be formed from a single sheet of material, as described above with respect to the bag 12. The reinforcement strap 141, however, can be formed as a strip of thicker material integral with the body 118 of the bag 112 and routed between the first and second handles 120, 122 and along the body 118 of the bag 112. In one embodiment, the reinforcement strap 141 can be integrally woven together with the body 118 of the bag 112. When a wire stack (e.g., 36) is provided into the bag 112, the reinforcement strap 141 underlies the wire stack. When the bag 112 is lifted with the first and second handles 120, 122, the weight of the wire stack can be substantially borne by the reinforcement strap 141. The body 118 of the bag 112 might not need to provide as much support as the body 18 shown in FIGS. 1 and 2 and can therefore be formed from thinner material, thereby improving cost and manufacturing time of the bag 112. It will be appreciated that although the bag 112 in FIG. 4 is shown to be octagonal-shaped, a bag having a reinforcement strap can be shaped in any of a variety of configurations such as rectangular-shaped (e.g., similar to bag 12).

It will be appreciated that the wire containment structure can facilitate more effective transportation of a wire stack than some conventional flexible intermediate bulk container (FIBC) arrangements. For example, a conventional FIBC can include a flexible body having four loop-type handles spaced evenly around an upper opening of the flexible body. Typically, the conventional FIBC can be filled with a granulated material such as sand, fertilizer, or pelletized plastic, for example and then lifted with the loop-type handles (e.g., by a forklift). A conventional FIBC, however, is ineffective for transporting a wire stack since the flexible body does not provide adequate protection for the wire stack. Reinforcing the conventional FIBC with a rigid container to protect the wire stack can be difficult and can even risk the integrity of the conventional FIBC. For example, a conventional FIBC provided loosely within a rigid container would be prone to falling into the rigid container thereby requiring retrieval of the conventional FIBC from the rigid container prior to lifting of the conventional FIBC. In addition, if the conventional FIBC is not properly aligned within the rigid container prior to loading the wire stack into the conventional FIBC, the loop-shaped handles may not be properly aligned with respect to the rigid structure and may even fall into the rigid structure. An approaching forklift may have difficulty sliding the forks through the loop-shaped handles without first retrieving the handles and without harmful contact with the rigid structure. The rigid container might accordingly be coupled with the conventional FIBC such as with releasable fasteners or adhesive to prevent the conventional FIBC from becoming separated from the rigid structure. Attaching the conventional FIBC to the rigid structure in this manner, however, can be costly and time consuming. In addition, when the conventional FIBC is lifted with the loop-shaped handles, the rigid container can pull and/or stress the FIBC which might affect the integrity of the conventional FIBC.

It will be appreciated therefore that the wire containment structure 10 can facilitate more effective lifting and/or storage of a wire stack (e.g., 36) than merely combining a conventional FIBC with a rigid container. For example, routing the first and second handles 20, 22 through the first and second apertures 40, 42 the container 14 can secure to the bag 12 to the container 14 without affecting the integrity of the bag 12. When the wire containment structure 10 is lifted with the first and second handles 20, 22, the first and second handles 20, 22 can hold the container 14 with respect to the bag 12 to prevent the container 14 from being inadvertently separated from the bag 12. The bag 12 can be configured to entirely support the weight of the wire stack 36 since the container 14 might not provide any underlying support to the wire stack 36 during lifting of wire containment structure 10. In addition, routing the first and second handles 20, 22 through the first and second apertures 40, 42 can ensure that the bag 12 is positioned properly within the container 14. Furthermore, the handles 20, 22 can be provided at a consistent location along the outside of the container 14 such that they are ready to receive a forklift's forks, as described above.

In some conventional wire containment structure arrangements, the bag might not be used for lifting a wire stack but rather merely serves as a moisture barrier. As described above, in such an arrangement a lifting strap is routed underneath the bag to facilitate lifting of the wire stack. It will be appreciated that the bag 12 can be used to lift and support the wire stack 36 in lieu of routing a lifting strap between the bag 12 and the container 14, which can reduce the overall cost of a wire containment structure. In addition, the bag 12 might be less susceptible to chafing that could otherwise occur from lifting a wire stack with the lifting strap. Furthermore, once the bag 12 is provided in the container 14 and the first and second handles 20, 22 are routed through the first and second handle apertures 40, 42, the first and second handles 20, 22 can be pulled to properly orient the bag 12.

Typically, before a wire stack is provided into a conventional wire containment structure, the lifting strap must be aligned beneath a bag to ensure that the weight of the wire stack is distributed properly over the lifting strap. Once the wire stack is lifted with the lifting strap, the lifting strap is still prone to moving out of position beneath the wire stack thereby increasing the risk that the wire stack can topple during transportation. The lifting strap can be formed as a webbed strap that has sufficient thickness to facilitate carrying of the wire stack and can thus be bulky and expensive.

The bag 12 therefore can support a wire stack more effectively than the lifting strap and in a more time effective and cost effective manner. Once the wire stack 36 is provided in the wire containment structure 10, the body 18 of the bag 12 can surround the wire stack 36 to provide more effective support to the wire stack 36 during lifting of the wire containment structure 10. Furthermore, even if the wire stack 36 shifts during transportation of the wire containment structure 10, the body 18 of the bag 12 remains beneath the wire stack 36 to prevent the wire stack 36 from becoming unbalanced within the container 14 and toppling over. It will also be appreciated that, by eliminating the use of a conventional lifting strap, the wire containment structure 10 may no longer be required to comply with certain safety and/or transportation standards which can be time consuming and costly to implement. Rather, the wire containment structure might be considered an FIBC with a corrugated overpack and thus might not be required to comply with the safety and/or transportation standards reserved for containers with lifting straps.

Although the bag 12 is shown to include only two handles, it will be appreciated that a bag can include more than two handles which can be routed through corresponding handle apertures of the container. It will also be appreciated that handles can be provided upon the bag 12 to reduce the risk of overturning that sometimes results by lifting an object with two handles. For example, as illustrated in FIG. 1, the first and second handles 20, 22 can be coupled with the upper portion 32 of the bag 12 and directly opposite each other. When the wire stack 36 is provided within the wire receptacle 24 of the bag 12, the first and second handles 20, 22 can be disposed on each side of the wire stack 36 and above the wire stack 36 to facilitate "top lifting". The center of gravity of the wire stack 36 can be vertically beneath the first and second handles 20, 22. Top lifting the wire containment structure 10 with the first and second handles 20, 22 is thus less susceptible to toppling than some conventional arrangements.

Although various embodiments of a wire containment structure have been illustrated by the foregoing description and been described in detail with respect to FIGS. 1-4, it is not intended to be exhaustive or to limit the scope of the appended claims to such detail. Numerous modifications are possible in light of the above teachings. Some of those modifications have been discussed and others will be understood by those skilled in the art.

What is claimed is:

1. An apparatus comprising:

a container comprising a sidewall that defines a container receptacle, the sidewall defining a first handle aperture and a second handle aperture;

a bag disposed at least partially within the container receptacle and comprising:

a body defining a wire receptacle;

a first handle routed through the first handle aperture;

a second handle routed through the second handle aperture; and a reinforcement strap associated with the first handle and the second handle and routed beneath the body; and a wire stack disposed within the wire receptacle of the bag; wherein:

the body, the first handle, the second handle, and the reinforcement strap comprise a woven material;

the reinforcement strap is woven integrally with the body;

the reinforcement strap and the body are formed from a unitary sheet of material and the reinforcement strap has a greater thickness than the body; and the bag is configured to entirely support the wire stack.

2. The apparatus of claim 1 wherein the first handle comprises a first looped end, the second handle comprises a second looped end, and the first looped end and the second looped end are disposed outside of the container receptacle.

3. The apparatus of claim 1 further comprising an inner support member that is disposed within the wire receptacle and is interposed between the wire stack and the bag.

4. The apparatus of claim 1 wherein the sidewall of the container defines a plurality of wall windows, the bag defines a plurality of bag windows, and each of the wall windows is substantially aligned with a respective one of the bag windows.

5. The apparatus of claim 4 wherein the bag windows and the wall windows are transparent.

6. The apparatus of claim 1 wherein the bag comprises a woven polypropylene bag and the container comprises a cardboard container.

7. The apparatus of claim 1 wherein the body of the bag comprises a lower portion and an upper portion, the upper portion extending beyond the container.

8. The apparatus of claim 7 wherein the body, the first handle, the second handle, and the reinforcement strap are provided in a one-piece construction.

9. A wire containment structure comprising:

a container comprising a sidewall that at least partially defines a container receptacle, the sidewall defining a first handle aperture and a second handle aperture; and a bag configured for entirely supporting a wire stack and comprising:

a body;

a first handle extending through the first handle aperture;

a second handle extending through the second handle aperture; and a means for reinforcing the body provided in a one-piece construction together with the body;

wherein the bag is disposed at least partially within the container receptacle, the means for reinforcing the body and the body are formed from a unitary sheet of material, and the means for reinforcing the body has a greater thickness than the body.

10. The wire containment structure of claim 9 wherein the first handle comprises a first looped end, the second handle comprises a second looped end, and the first looped end and the second looped end are disposed outside of the container receptacle.

* * * * *

UNITED STATES PATENT AND TRADEMARK OFFICE

CERTIFICATE OF CORRECTION

PATENT NO. : 8,365,912 B2
APPLICATION NO. : 12/909230
DATED : February 5, 2013
INVENTOR(S) : Carroscia et al.

It is certified that error appears in the above-identified patent and that said Letters Patent is hereby corrected as shown below:

IN THE SPECIFICATIONS:

Column 1, line 8, change “facilitate, lifting” to --facilitate lifting--;
Column 1, line 16, change “includes, a” to --includes a--;
Column 1, line 59, change “depicting it wire” to --depicting a wire--;
Column 2, line 10, change “and container” to --and a container--;
Column 3, line 66, change “heat” to --be at--;
Column 5, line 50, change “of wire” to --of the wire--; and
Column 6, line 53, change “and been” to --and have been--.

Signed and Sealed this
Ninth Day of April, 2013

Teresa Stanek Rea
*Acting Director of the United States Patent and Trademark Office*